US005779427A

United States Patent [19]

Heffinger

[11] Patent Number: 5,779,427

[45] Date of Patent: Jul. 14, 1998

[54] RAILWAY CAR VIBRATOR HANDLING DEVICE

[76] Inventor: George R. Heffinger, 238 Longhook Rd., Eden, N.C. 27288

[21] Appl. No.: 713,917

[22] Filed: Sep. 13, 1996

[51] Int. Cl.[6] ..... B65G 67/24

[52] U.S. Cl. ..... 414/375

[58] Field of Search ..... 414/375, 744.3, 414/744.5, 744.7, 744.8; 366/113, 114

[56] References Cited

U.S. PATENT DOCUMENTS

| | | | |
|---|---|---|---|
| 2,621,813 | 12/1952 | Bauerle et al. | 414/375 X |
| 2,818,184 | 12/1957 | Matson | 414/375 |
| 3,128,892 | 4/1964 | Plant | 414/375 |
| 4,068,768 | 1/1978 | Hicks, Jr. . | |
| 4,221,521 | 9/1980 | Kirwan | 414/375 |
| 4,224,006 | 9/1980 | Dumbaugh et al. | 414/375 |
| 4,295,775 | 10/1981 | Cottrill et al. | 414/375 |
| 4,307,989 | 12/1981 | Dumbaugh | 414/375 |
| 4,412,762 | 11/1983 | Lepley et al. | 406/134 |
| 4,428,710 | 1/1984 | Grisebach et al. | 414/744.5 X |
| 4,852,237 | 8/1989 | Tradt et al. | 414/744.5 X |
| 5,085,556 | 2/1992 | Ohtomi | 414/744.3 |
| 5,160,238 | 11/1992 | Kambara | 414/744.3 X |

OTHER PUBLICATIONS

National Car Shaker Brochure, National Conveyor and Supply Company, May 1955.

Syntron Car Shaker Brochure, Syntron Company, Apr. 1960.

*Primary Examiner*—James W. Keenan

[57] ABSTRACT

A device is provided to easily position a conventional vibrator on a railway hopper car to assist in unloading various granular materials. The device includes a stanchion mounted beside a railway track which supports a swingable arm. The arm includes a distal pivotable vibrator carrier section. A hydraulic jack allows the arm to be raised as needed. Pneumatic cylinders permit the operator to precisely control and move the vibrator releasably held by the vibrator carrier to a pocket positioned on the car hopper. The vibrator after being released receives compressed air which shakes the hopper of the railway car to insure proper granular flow during emptying. Once the railway car is unloaded, the device is then used to withdraw the vibrator from the hopper car pocket and move it out of the way so another car can he positioned for unloading.

6 Claims, 5 Drawing Sheets

RAILWAY CAR VIBRATOR HANDLING DEVICE

FIELD OF THE INVENTION

The invention herein pertains to unloading railway hopper cars and specifically to the application of a mechanical vibrator thereto for insuring the free flow of granular materials contained therein. A pivotable arm of the handling device will place the vibrator on the railway hopper car and after use, will remove the vibrator.

BACKGROUND AND OBJECTIVES OF THE INVENTION

With the high cost of medical insurance and workman's compensation claims of recent years, employers have become increasingly attentive to the working conditions and tasks of their employees. In the unloading operation of railway hopper cars, which haul a variety of granular materials ranging from grain to sand, it has been found necessary to manually attach a vibrator to the hopper cars during unloading to ensure a proper and complete flow of the cargo in order to completely empty the car. Conventional vibrators are used which are driven by compressed air and which may weigh, for example, from 50 to 100 pounds. Handling such a vibrator can be difficult, especially since the workers must crawl somewhat under the hopper cars to affix and remove the vibrator. Bending, stooping, stretching and lifting must be undertaken in order to attach and detach the vibrator. Back injuries are frequent, as are less serious muscle pulls and strains due to the physical effort exerted.

These injuries can be debilitating and can cause the loss of many man hours over a period of a few months. Supervisors must be careful to select only the strongest of employees to handle and attach vibrators and such selections can cause friction among the employees. Without the vibrators being used, the railway hopper cars may not empty a percentage of their cargo, causing the shippers to be dissatisfied at the railway service, and look for alternatives for their shipping needs. Thus, it is one objective of the invention to provide a handling device for a railway hopper car vibrator which relieves the operator of most of the manual lifting involved.

It is another objective of the invention to provide a vibrator handling device having an arm which is composed of several pivotable sections to easily control exact placement of the vibrator in a railway hopper car pocket.

It is yet another objective of the present invention to provide a vibrator handling device which can be pivotally mounted proximate the railway tracks for convenience in use.

It is still another objective of the present invention to provide a vibrator handling device which will lift and transport a vibrator through the use of pneumatic controls.

It is another objective of the invention to provide a vibrator handling device, the operation of which can be easily learned, and which will handle a variety of conventional vibrators.

Other objectives and advantages of the present invention will become apparent to those skilled in the art as a full description of the invention is reviewed below.

SUMMARY OF THE INVENTION

The aforesaid and other objectives are realized by providing a vibrator handling device which includes a stanchion and a pivotable arm affixed thereto. A hydraulic jack will lift and lower the arm vertically as needed. The arm has first and second rectangular sections which are hingedly affixed. A vibrator carrier is pivotally joined to the second arm section to move in a vertical, arcuate path. The vibrator carrier is pneumatically controlled and includes a vibrator gripper which will pneumatically lock and unlock so as to hold and release a vibrator thereon as desired.

In use, with the vibrator locked in the vibrator gripper of the vibrator carrier, the arm is swung beneath the hopper car and the vibrator carrier is pneumatically tilted forwardly whereby the vibrator slide can be positioned within a pocket mounted on the hopper car. The operator then pneumatically controls the gripper to release the vibrator after which, the arm is swung out of the way. Next, compressed air is delivered to the vibrator as the hopper car is being unloaded to insure that all granular material contained therein is fully evacuated. Thereafter, the vibrator handling device arm is again swung to the hopper car where the vibrator carrier engages the vibrator and the vibrator gripper secures the vibrator for removal purposes. By reversing the arcuate movement of the vibrator carrier, the vibrator is lifted from the hopper car pocket and the arm with the vibrator attached is then swung out of the path of the hopper car. The hopper car can then be moved along the railway tracks and the next hopper car can be unloaded as the process is repeated. As would be understood, most unloading stations have large holding tanks beneath the rails for receiving the cargo from the hopper cars.

DETAILED DESCRIPTION OF THE PREFERRED EMBODIMENT AND OPERATION OF THE INVENTION

Figure 1:
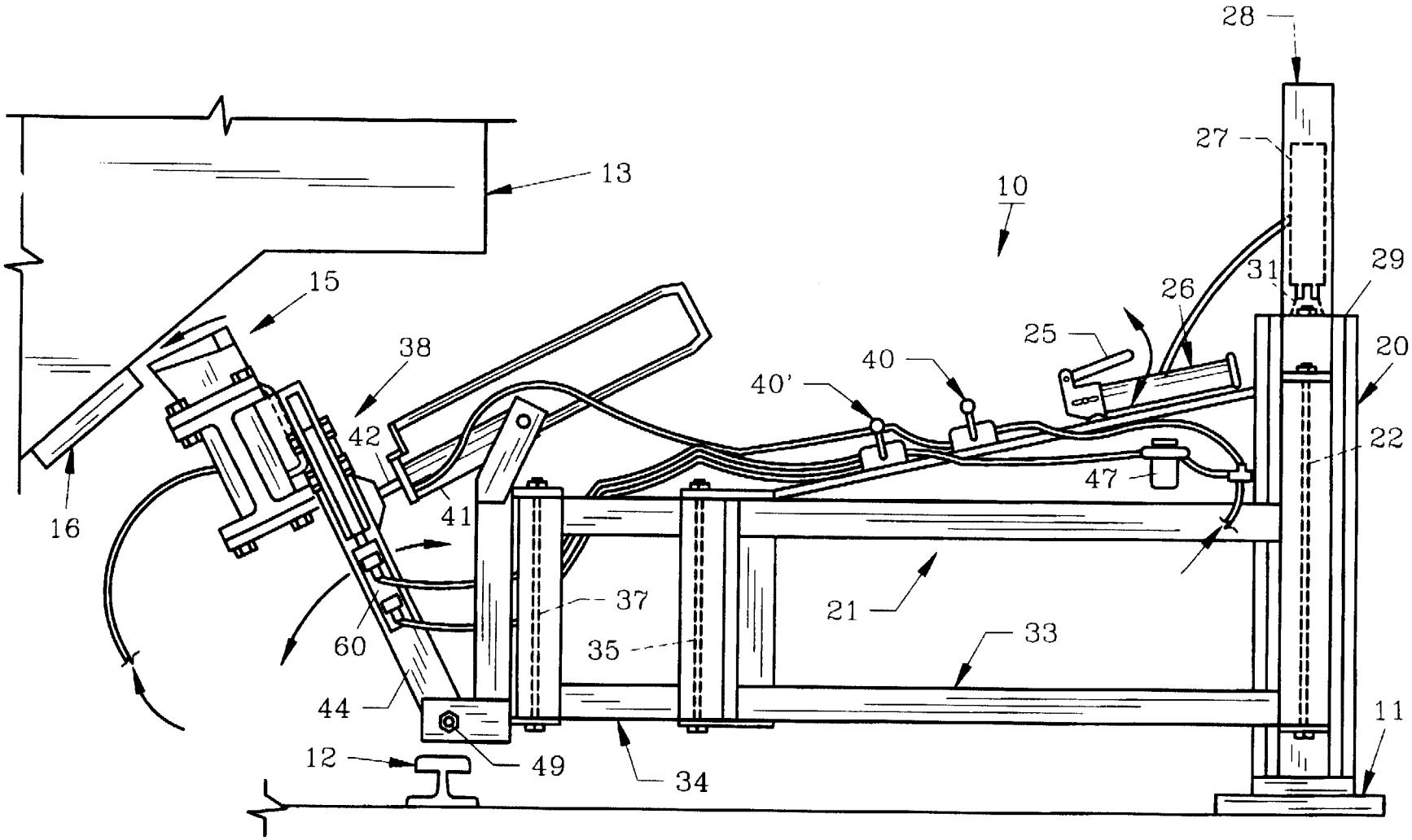
FIG. 1 shows a side elevational view of the vibrator handling device positioned proximate a railway hopper car.

For a better understanding of the invention and its operation, turning now to the drawings, vibrator handling device 10 is seen in FIG. 1 mounted on base 11 proximate railway track 12. Railway hopper car 13 is depicted in abbreviated form as would be positioned on track 12 and a second parallel track (not shown). Vibrator handling device 10 places conventional vibrator 15 onto hopper car 13 by positioning it within hopper car pocket 16. After vibrator 15 is positioned within pocket 16, handling device 10 releases vibrator 15 whereupon air is supplied from a compressor (not shown) to allow vibrator 15 to operate as hopper car 13 is emptied into a holding tank (usually beneath the railway tracks). After hopper car 13 is unloaded, the air supply to vibrator 15 is terminated and handling device 10 then extracts vibrator 15 from hopper pocket 16 and repeats the cycle for subsequent hopper cars moved into position.

It has been heretofore laborious and difficult to position vibrator 15 within pocket 16 of hopper car 13 by manual efforts alone due to the space constraints beneath hopper car 13 and the heavy weight of vibrator 15. Vibrator handling device 10 removes the laborious physical effort needed and is adjustable so different hopper cars can be affixed with vibrators quickly and easily. As shown, vibrator handling device 10 is mounted on base 11 by attachment of stanchion 20 thereto. Arm 21 is hingedly joined to stanchion 20 whereby arm 21 will swing around axle 22. In the event arm 21 is positioned too low to adequately serve hopper car 13, handle 25 of hydraulic jack 26 can be operated to deliver hydraulic pressure to cylinder 27. Hydraulic cylinder 27 is attached to stanchion upright 28 which in turn is mounted to stanchion slide 29. As further shown in FIG. 1, hydraulic cylinder 27 includes piston rod 31 which is in contact with stanchion 20 whereby extension of piston rod 31 will cause stanchion upright 28 to move upwardly as stanchion slide 29 moves upwardly relative to stanchion 20.

Arm 21 includes a first rectangular section 33 formed from metal tubing or the like and a shorter second rectangular section 34, also formed from metal tubing. Rectangular section 34 is hingedly mounted to section 33 by axle 35. Vibrator carrier 38 is likewise joined to section 34 and hinges along axle 37. Vibrator carrier 38 is also pivotable in a vertical direction along horizontal axle 49. Control lever 40 controls the air from pressure regulator 47 to pneumatic cylinder 41 which extends piston rod 42 thereby pivoting vibrator carrier member 38. Control lever 40' controls the air to cylinder 60 which locks or unlocks vibrator 15 by extending or withdrawing locking plate 64 as seen in FIGS. 6–9.

Figure 2:
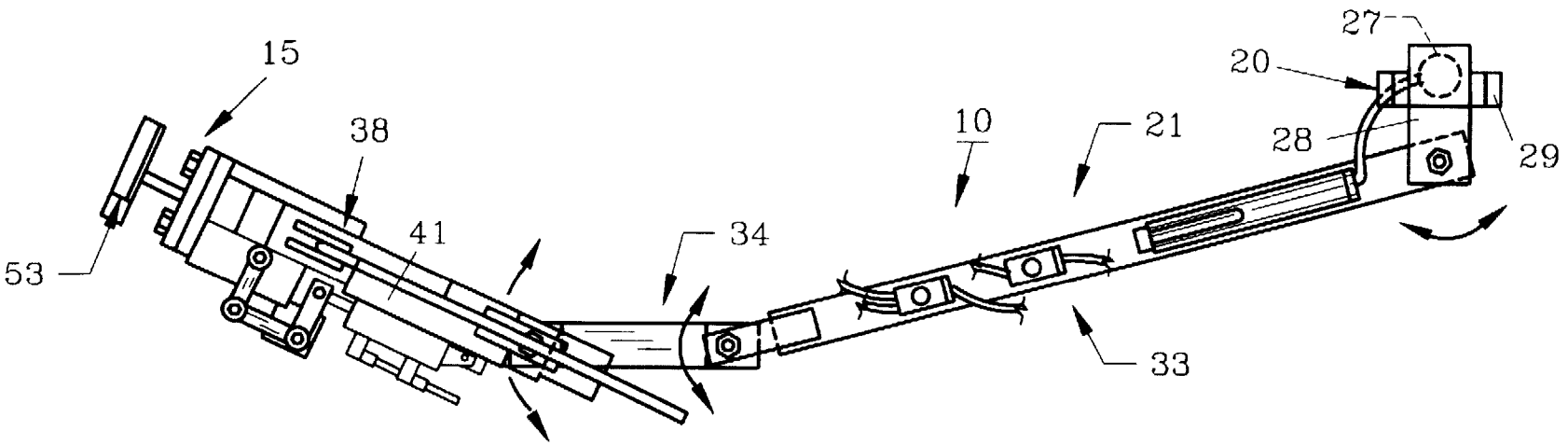
FIG. 2 illustrates in schematic form a top view of the vibrator handling device.

FIG. 2 provides a view along the top of handling device 10 without hopper car 13 to better show certain relevant components and their spatial relation.

Figure 3:
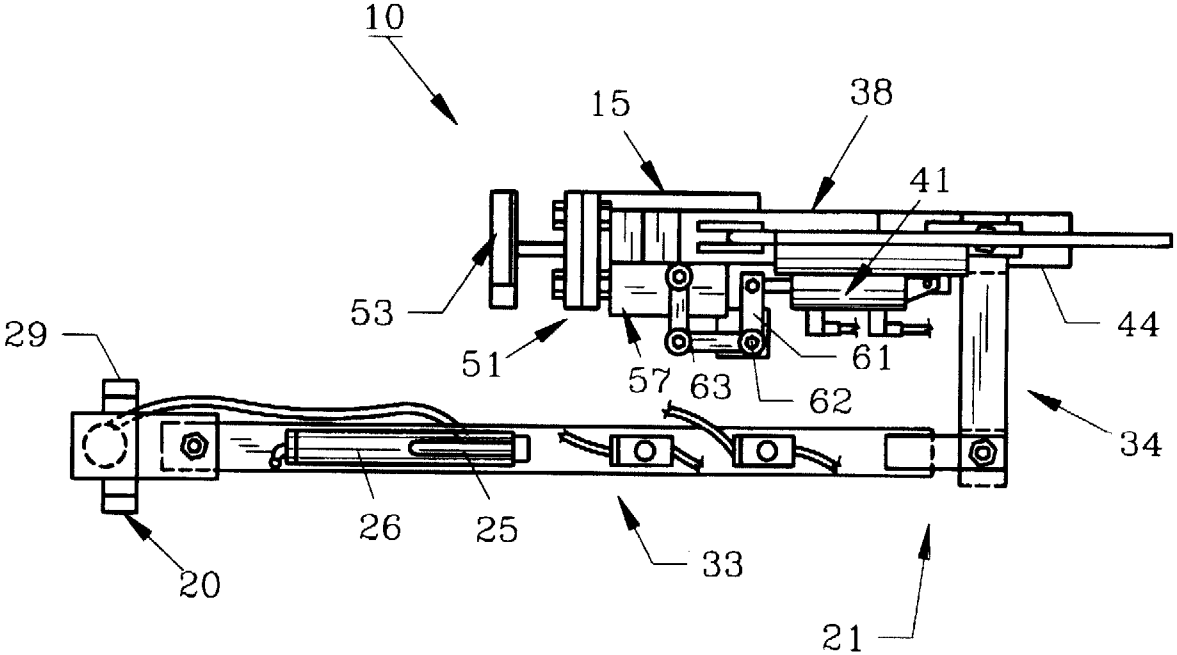
FIG. 3 shows the vibrator handling device as seen in FIG. 1 configured as when not in use.
Figure 5:
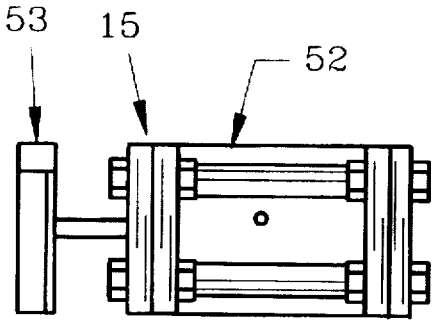
FIG. 5 demonstrates another view of the vibrator as seen in FIG. 4 along lines 5—5.
Figure 4:
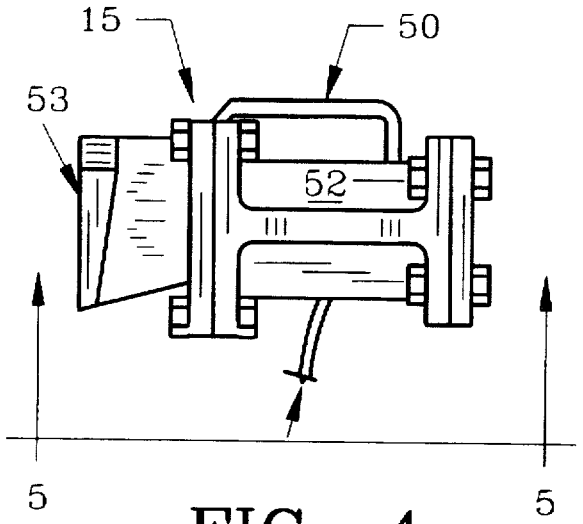
FIG. 4 depicts a conventional vibrator as used with the invention herein.

Vibrator 15 (FIGS. 4, 5) which has been used for many years in the industry, includes handle 50 (FIGS. 3, 9) which is attached to housing body 52. Vibrator attaching blade 53 is affixed to housing body 52 for insertion into hopper car pocket 16, as seen in FIG. 1.

Figure 9:
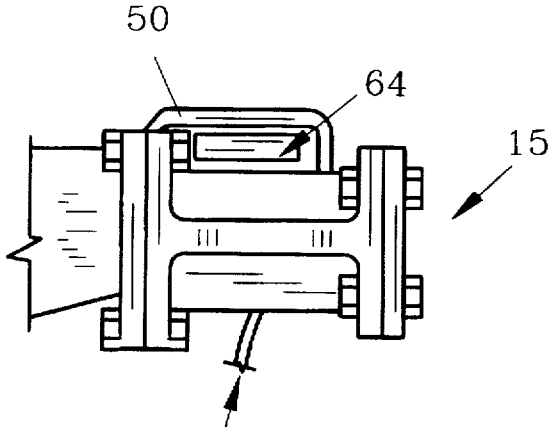
FIG. 9 shows the vibrator locking plate as positioned with the vibrator handle for gripping purposes.
Figure 8:
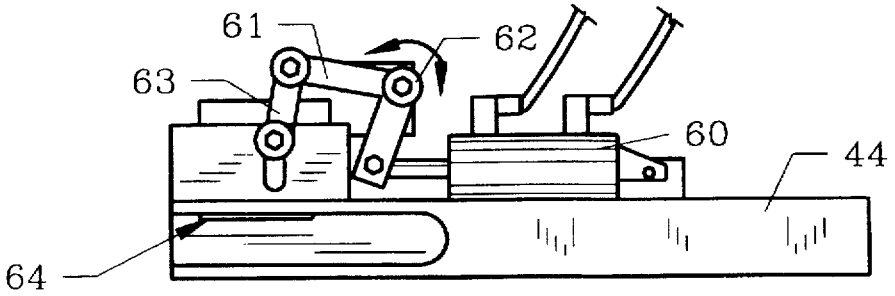
FIG. 8 illustrates a side view of the carrier as shown in FIG. 6 but with the vibrator locking plate withdrawn.
Figure 6:
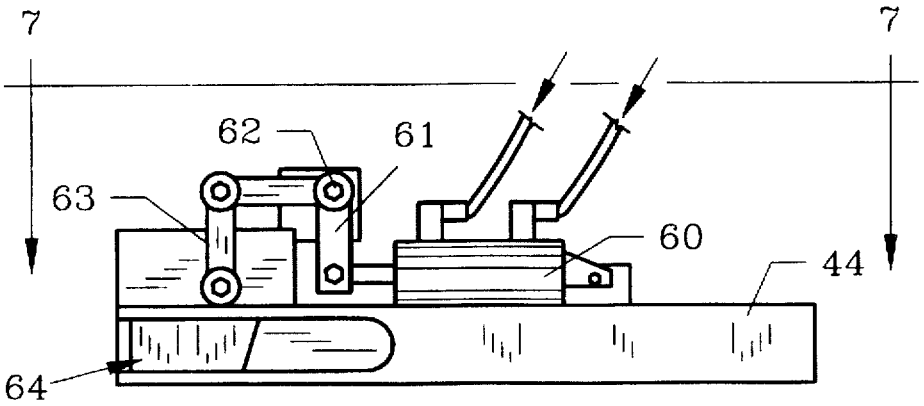
FIG. 6 depicts a view of the vibrator carrier as removed from the handling device.
Figure 7:
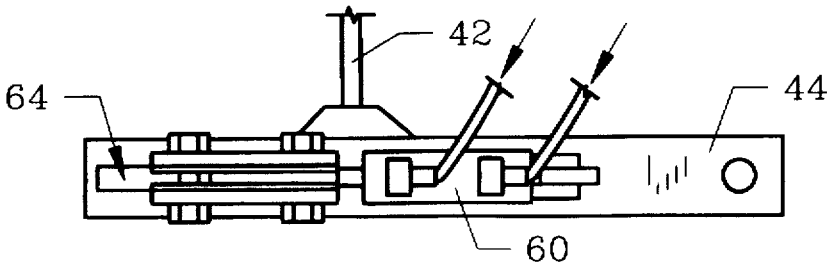
FIG. 7 demonstrates the vibrator carrier as seen in FIG. 6 along lines 7—7.

Elongated member 44 of vibrator carrier 38, as seen in FIGS. 6—8 is a rectangular, metal tubular member having pneumatic cylinder 60 mounted therealong. Pneumatic cylinder 60 drives v-shaped linkage 61 which rotates through pivot point 62 to push or pull linear linkage 63 which is attached to wedge-shaped vibrator locking plate 64 (FIG. 6). Vibrator locking plate 64 is urged by pneumatic cylinder 60 within handle 50 as seen in FIG. 9 to thereby tightly grip vibrator 15 so it can be delivered to or extracted from hopper car pocket 16, as shown in FIG. 1.

The illustrations and examples provided herein are for explanatory purposes and are not intended to limit the scope of the appended claims.

I claim:

1. A vibrator handling device for positioning a vibrator on a railway car in combination with a railway car and a vibrator, said vibrator comprising a handle, said handling device comprising:

a stanchion, an arm, said arm comprising a first section and a second section, said first section hingedly joined to said second section;

said arm pivotally joined to said stanchion at a first elevation and extending horizontally therefrom;

means to vertically control said arm, said vertical control means affixed to said arm;

an elongated member, said elongated member pivotally attached to said arm:

a wedge shaped vibrator locking plate, said vibrator locking plate movably positionable along said elongated member, said vibrator locking plate engaging said vibrator handle;

a vibrator carrier, said vibrator carrier pivotally attached to said arm to transfer said vibrator to said railway car at a position having an elevation equal to or greater than that of said first elevation; and a fluid operated cylinder, said fluid operated cylinder joined to said vibrator carrier.

2. The combination of claim 1 wherein said fluid operated cylinder comprises a first pneumatic cylinder; wherein said control means comprises a hydraulic cylinder; and wherein said vibrator handling device further comprises a second pneumatic cylinder, said second pneumatic cylinder attached to said vibrator locking plate for controlling movement thereof.

3. In combination:

a railway hopper car, said car comprising a downwardly facing surface, and a pocket, said pocket positioned on said downwardly facing surface;

a portable vibrator, said vibrator adapted to fit within said pocket on said railway car; and a handling device suitable for moving said portable vibrator to and from said downwardly facing surface of said railway hopper car, said handling device comprising:

a vertical stanchion;

a horizontal arm affixed at a proximal end thereof at a first elevation to and extending from said stanchion to a distal end of said arm, said arm comprising hingedly joined first and second sections, said arm vertically adjustable;

a vibrator carrier mounted to said arm about a v-shaped linkage and adapted to receive said portable vibrator at a distal end of said vibrator carrier, said v-shaped linkage pivotable at the bottom of the v-shape so that said vibrator carrier pivots about said v-shaped linkage in a vertical plane; and a power source suitable for pivoting said vibrator carrier about said v-shaped linkage to position said vibrator carrier distal end at an elevation equal to or higher than said first elevation.

4. The combination of claim 3 wherein said power source of said handling device is a fluid operated cylinder supported by said arm.

5. The combination of claim 4 wherein said fluid operated cylinder comprises a pneumatic cylinder.

6. A combination of a vibrator and a vibrator handling device:

said vibrator comprising a handle;

said handling device comprising: <a vertical stanchion;

a horizontal arm affixed at a proximal end thereof at a first elevation to and extending from said stanchion to a distal end of said arm, said arm comprising hingedly joined first and second sections, said arm vertically adjustable;

a vibrator carrier mounted to said arm about a v-shaped linkage and adapted to receive said portable vibrator at a distal end of said vibrator carrier, said v-shaped linkage pivotable at the bottom of the v-shape so that said vibrator carrier pivots about said v-shaped linkage in a vertical plane;

a power source, said power source suitable for pivoting said vibrator carrier about said v-shaped linkage to position said vibrator carrier distal end at an elevation equal to or greater than said first elevation;

an elongated member;

a pneumatic cylinder; and a wedge shaped vibrator locking plate, said elongated member pivotally attached to said second arm section, said vibrator locking plate movably positionable along said elongated member, said locking plate releasably engaging said vibrator handle, said pneumatic cylinder attached to said vibrator locking plate for controlling movement thereof.

* * * * *